US007281487B1

(12) United States Patent
Placek

(10) Patent No.: US 7,281,487 B1
(45) Date of Patent: Oct. 16, 2007

(54) ADJUSTABLE BOAT PLATFORM INSERT

(76) Inventor: Steven R. Placek, 2028 Hayden Ave., Altoona, WI (US) 54720

( * ) Notice: Subject to any disclaimer, the term of this patent is extended or adjusted under 35 U.S.C. 154(b) by 400 days.

(21) Appl. No.: 10/806,859

(22) Filed: Mar. 23, 2004

(51) Int. Cl.
*B63B 17/00* (2006.01)

(52) U.S. Cl. ..... 114/363; 114/343

(58) Field of Classification Search ..... 114/352–354, 114/363, 343, 364; D12/317
See application file for complete search history.

(56) References Cited

U.S. PATENT DOCUMENTS 828,072 A * 8/1906 Tenneson ..... 114/354
4,624,209 A * 11/1986 Loffler ..... 114/354
4,671,009 A 6/1987 Faunce
4,698,034 A * 10/1987 Anthonijsz ..... 440/27
4,738,217 A 4/1988 Smith
4,766,838 A * 8/1988 Johnson ..... 114/363
5,092,263 A 3/1992 Hutchison et al.
5,209,178 A 5/1993 Rowe
5,826,532 A 10/1998 Elvestad
5,868,096 A 2/1999 Elvestad
6,101,966 A 8/2000 Cuminsky
6,405,985 B1 6/2002 Glebe

* cited by examiner

*Primary Examiner*—Ed Swinehart
(74) *Attorney, Agent, or Firm*—John D. Gugliotta, Pe, Esq.

(57) ABSTRACT

An adjustable boat platform is provided that attaches to a conventional boat and transforms it into a fishing platform typically found on a bass boat. The invention attaches to the perimeter of just about any "V"-bottom boat using special slots and locking pins.

11 Claims, 4 Drawing Sheets

ADJUSTABLE BOAT PLATFORM INSERT

RELATED APPLICATIONS

The present invention contains subject matter that was first described in Disclosure Document Registration 528,486 filed on Mar. 24, 2003 under 35 U.S.C. §122 and 37 C.F.R. §1.14. As such, it is respectfully requested that said Disclosure Document is incorporated herein by reference as if fully rewritten and remain a permanent part of the file history of the present application and be relied upon during the pending prosecution, and for any other matters that may arise.

There are no previously filed, nor currently any co-pending applications, anywhere in the world.

BACKGROUND OF THE INVENTION

1. Field of the Invention

The present invention relates generally to boat accessories, and, more particularly, to an adjustable boat platform insert that transforms a conventional v-hull or flat bottom boat into a bass boat. The present invention can be used in other manners than the preferred embodiment as said invention may be adapted to meet other needs. Such needs are envisioned to include being mounted on various footings to provide a means of transporting the invention. Other uses as a floating platform, ice shack, small boat, or general storage.

2. Description of the Related Art

Fishing is a hobbyist type sport that enjoyed around the world, by the young and old alike. After the fishing rod and tackle box, the fishing boat is the next most common piece of apparatus used in fishing. And, as with most apparatus, the fishing boat can be a very specialized piece of equipment. Many fishermen and applications prefer the size and maneuverability of a conventional "V" shaped hull boat, while others prefer the large area, elevated platform and comfort of a bass-style boat. While some people own multiple boats to ideally fit any fishing situation, others cannot enjoy such luxury due to cost constraints, storage limitations or usage requirements.

A search of the prior art did not disclose any patents that read directly on the claims of the instant invention; however, the following references were considered related:

| U.S. Pat. No. | Description |
|---|---|
| 6,405,985 | Universal platform with horizontal mounting surface |
| 5,092,263 | Boat utility platform and mounting clamp therefor |
| 6,101,966 | Multipurpose utility station for boat with adjustable mount |
| 4,671,009 | Boat fishing organizer formed as basket-like structure with attachment means for fishing accessories |
| 5,209,178 | Dual position boat seat |
| 4,738,217 | Stern conversion seat and raised casting platform |
| 5,868,096 | Boat seat |
| 5,826,532 | Boat seat |

Consequently, there exists a need for a means by which a conventional "V" shaped hull boat can be easily adapted to provide the comforts and conveniences of a bass-type boat without the disadvantages as listed above.

| DESCRIPTIVE KEY | |
|---|---|
| 10 | adjustable boat platform insert |
| 15 | conventional V-bottom boat |

-continued

| DESCRIPTIVE KEY | |
|---|---|
| 20 | forward seat |
| 25 | aft seat |
| 30 | captive pin set |
| 35 | platform |
| 40 | frame |
| 45 | central seat |
| 50 | seat support stand |
| 55 | storage compartments |
| 60 | forward access hatch |
| 65 | rear access hatch |
| 70 | anchor access hatch |
| 75 | forward direction arrow |
| 80 | forward seat arm |
| 85 | forward brace arms |
| 90 | lower first brace |
| 95 | first adjustable pins |
| 100 | rear seat arm |
| 105 | rear brace arms |
| 110 | lower second brace |
| 115 | second adjustable pins |
| 120 | third adjustable pins |
| 125 | intermediate support brackets |
| 130 | intermediate support |
| 132 | first extension member |
| 134 | seat support mount |
| 136 | fourth adjustable pins |
| 137 | second extension member |
| 138 | fifth adjustable pin |
| 140 | compartment hinges |
| 145 | storage compartment lid |
| 150 | hatch hinges |
| 152 | elongated holes |
| 155 | below deck storage space |
| 160 | container wall |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 5.

1. Detailed Description of the Figures

Figure 1:
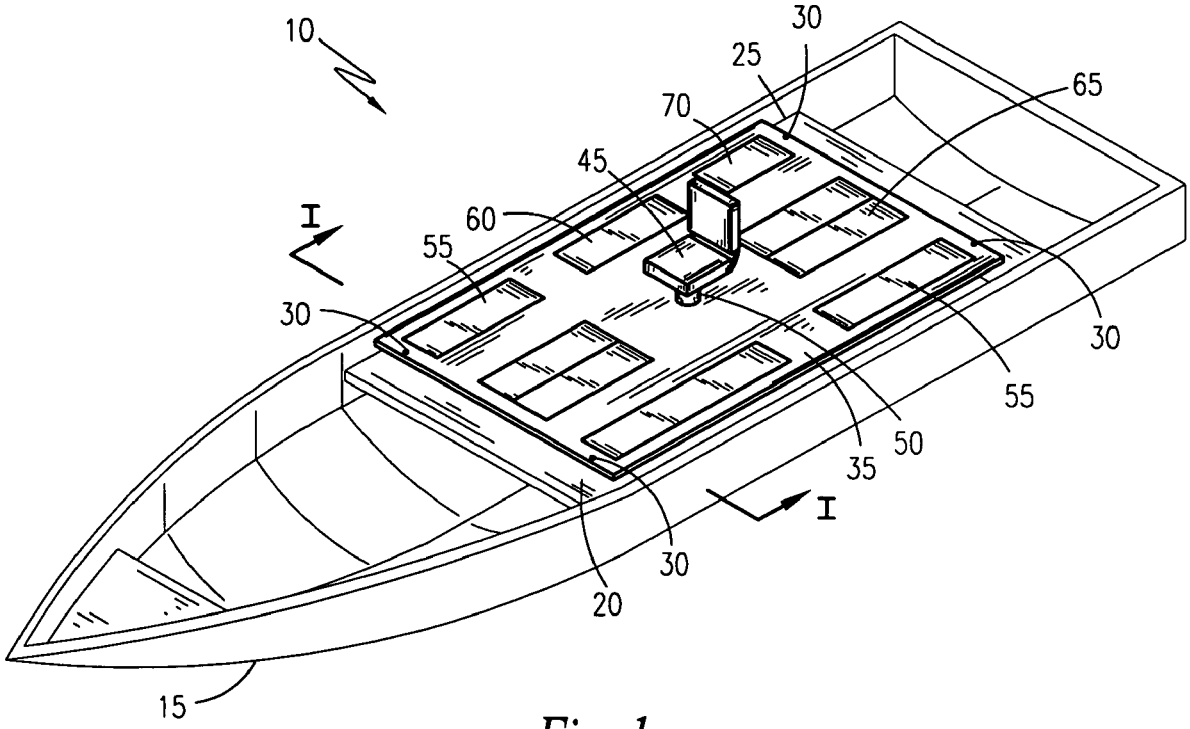
FIG. 1 is an isometric view of the adjustable boat platform insert 10 shown in an installed state on a conventional v-bottom boat, according to a preferred embodiment of the present invention.

Referring to FIG. 1, an isometric view of the adjustable boat platform insert 10 installed upon a conventional V-bottom boat 15 according to a preferred embodiment of the present invention is disclosed. A forward seat 20 and a aft seat 25 are provided in their normally expected locations. The forward seat 20 and the aft seat 25 are envisioned to be of a normal bench type and can be made of aluminum, steel, wood, fiberglass or other commonly available material. A captive pin set 30 secures a platform 35 to a frame 40 (not shown in this FIG.) at six locations, two at the forward corners, two at the middle, and two at the aft corners. The platform 35 provides a flat, level, stable and elevated surface from which to perform fishing operations from. The overall function provided by said platform 35 is similar to that afforded by other types of fishing vessels such as a bass boat. A central seat 45 is provided in a central location affixed to a seat support stand 50 which is mounted to the frame 40 (not visible in this view). A plurality of storage compartments 55 are provided around the platform 35. A forward access hatch 60 is provided at the forward part of the platform 35, and a similar rear access hatch 65 is provided at the rear part of the platform 35. The rear access hatch 65 allows the use of the v-hull boat in a conventional manner by opening the hatches that allow the operator to operate the boat as they would normally operate without a platform. Finally, an anchor access hatch 70 is located at the rear part of the platform 35 near the outboard side. The anchor access hatch 70 is to allow the operator to access a anchor winch or a anchor.

Figure 2:
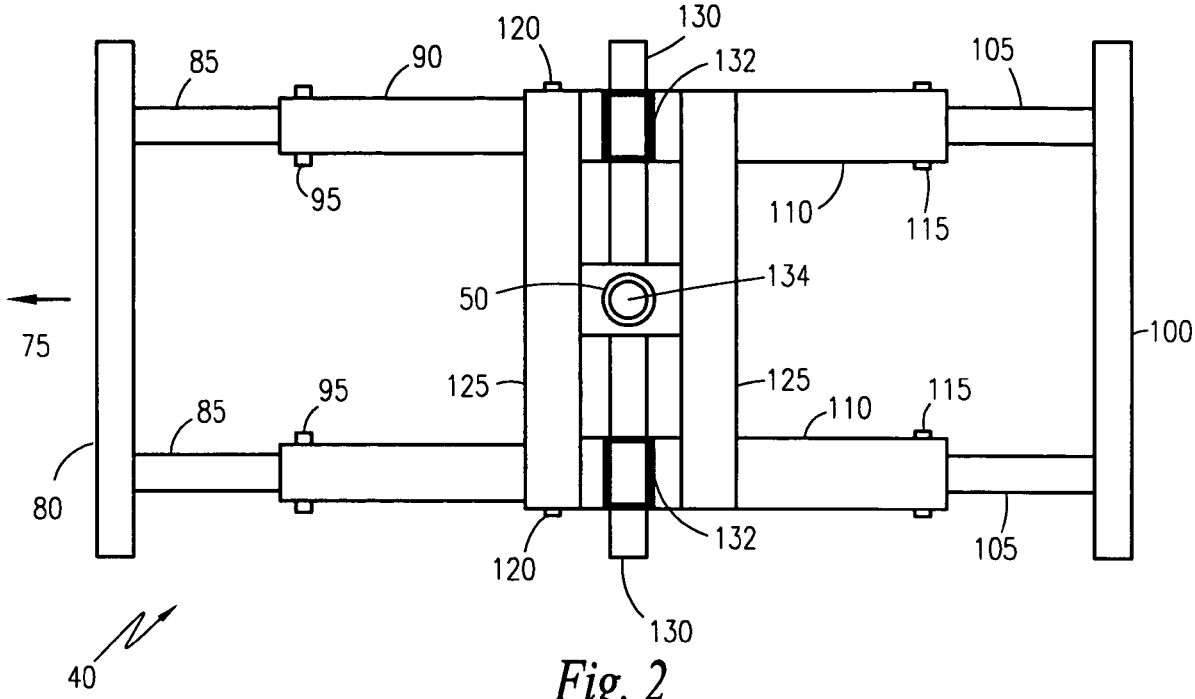
FIG. 2 is a top view of the frame 40 as used with the adjustable boat platform insert 10.

Referring now to FIG. 2, a top view of the frame 40 is depicted. This FIG. more clearly depicts the underlying structure of the adjustable boat platform insert 10. A forward seat arm 80 is provided with a set of two affixed forward brace arms 85 which are connected to a lower first brace 90 via a set of first adjustable pins 95. The first adjustable pins 95 provides an adjustment point to allow the frame 40 to fit the conventional V-bottom boat 15 (not shown in this FIG.) of varying sizes. In a similar manner, a rear seat arm 100 is provided with a set of two affixed rear brace arms 105 which are connected to a lower second brace 110 via a set of second adjustable pins 115. It is envisioned that the forward brace arms 85, the lower first brace 90, the rear brace arms 105 and the lower second brace 110 is manufactured of tubular aluminum or other lightweight and strong material, thus allowing the components to fit inside one of another and allow for expansion as necessary. While the forward brace arms 85 and the rear brace arms 105 allow for adjustment to suit seats of varying heights, a set of third adjustable pins 120 allow the lower first brace 90 and the lower second brace 110 to adjust in overall length to suit the distance between the forward seat 20 (as shown in FIG. 1) and aft seat 25 (as shown in FIG. 1). Each lower second brace 110 is affixed in its position from the other by a set of intermediate support brackets 125, which provide for structural stability and provide a base for the seat support stand 50. The seat support mount 134 would slide into the seat support stand 50 being adjusted by the fifth adjustable pin 138. An intermediate support 130 provides additional support for the platform 35 (not shown in this FIG.) Intermediate support 130 has the second extension member 137 that would slide in the same manner as the other adjustable parts into the first extension member 132 that extends off the lower second brace 110. Said supports are adjusted with fourth adjustable pins 136.

Figure 3:
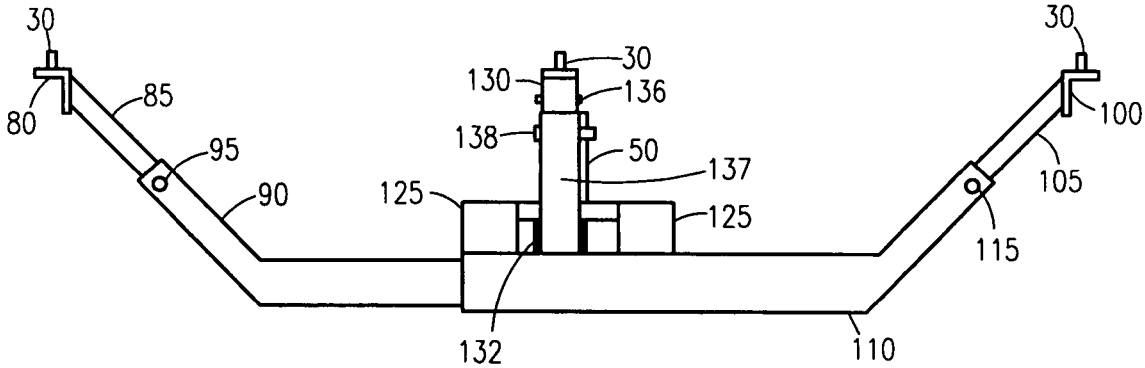
FIG. 3 is a side view of the frame 40 as used with the adjustable boat platform insert 10.

Referring next to FIG. 3, a side view of the frame 40 is disclosed. This FIG. more clearly shows the relationship of the frame 40 and the manner which it provides support for the platform 35. The set of six captive pins set 30 (of which only three are visible in this view) are clearly visible atop the forward seat arm 80, the intermediate support 130 and the rear seat arm 100. The forward brace arms 85 adjusts in and out of the lower first brace 90 as adjusted by the first adjustable pins 95. The rear brace arms 105 adjusts in and out of the lower second brace 110 as adjusted by the second adjustable pins 115. The intermediate support 130 is positioned by a fourth adjustable pins 136 that go through a second extension member and first extension member 132 that extend off of the intermediate support 130 and the lower second brace 110. These extensions extend upward with the intermediate support 130 sliding into the first extension member 132 as the other adjustable parts. The seat support stand 50 extends upward through the intermediate support 130 with the intermediate support encircling the seat support stand 50 at it center with the seat support mount 134 sliding into the seat support stand 50 the fifth adjustable pin 138 passing through them above the intermediate support 130.

Figure 4:
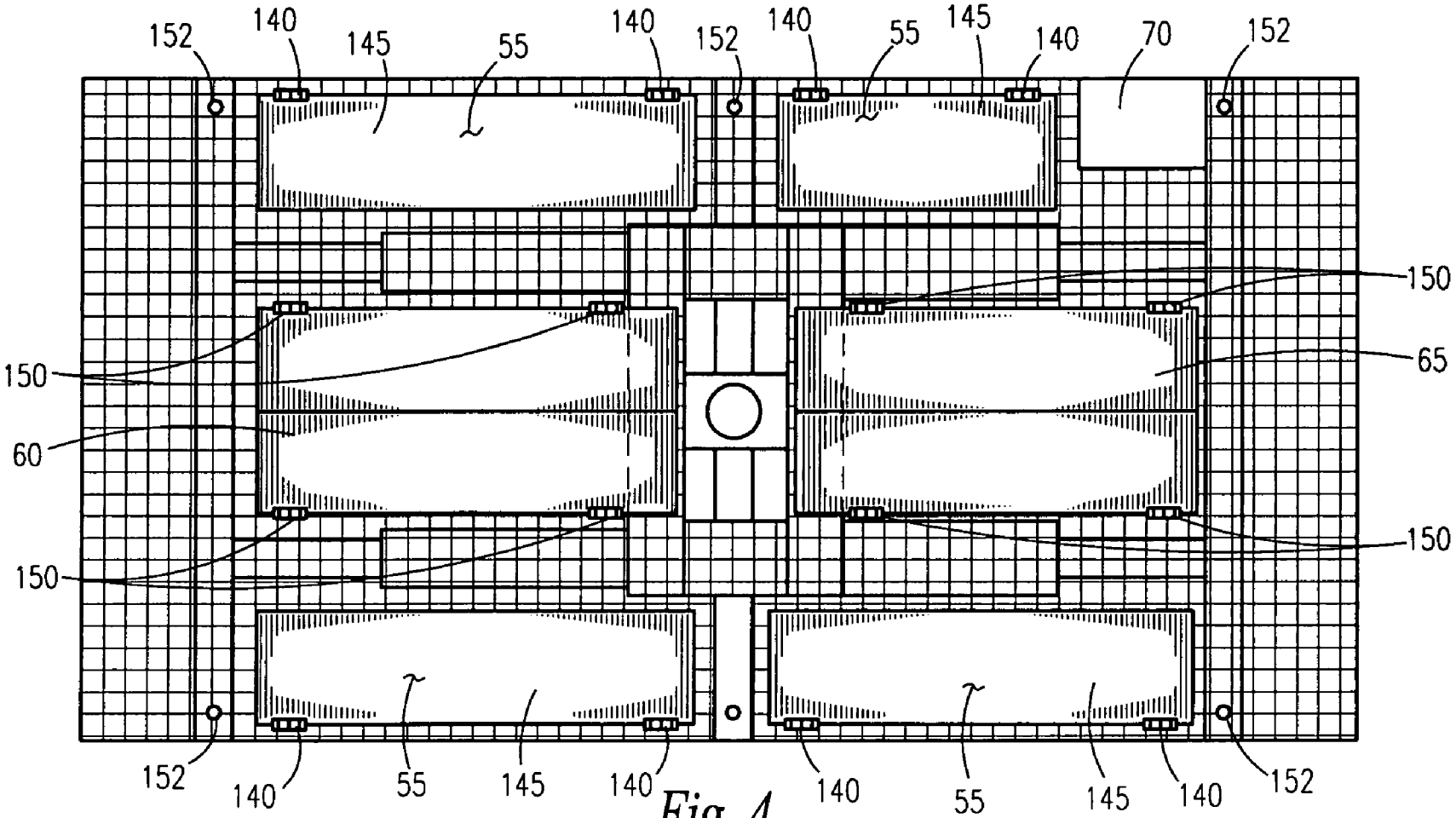
FIG. 4 is a top view of the platform 35 as used with the adjustable boat platform insert 10, and, FIG. 5 is a sectional view of the adjustable boat platform insert 10 as seen along a line I-I as seen in FIG. 1.

Referring now to FIG. 4, a top view of the platform 35 is disclosed. The storage compartments 55, of which four are provided in this embodiment, provide access to individual compartments such as storage lockers, thermally insulated coolers, live bait containers, fish storage coolers and the like. Their proximity to the outward portion of the platform 35 provide for easy access. A pair of compartment hinges 140 on each storage compartment lid 145 holds it captive and prevents the storage compartment lid 145 from being lost overboard. The forward access hatch 60 and the rear access hatch 65 serve as points to allow access to the underside of the platform 35 as bordered by the hull of the conventional V-bottom boat 15 (not shown in this FIG.) The forward access hatch 60 and the rear access hatch 65 are bifold type hatches, and are held captive by sets of hatch hinges 150. Finally, the anchor access hatch 70 provides storage for an anchor if so used, as aforementioned described. Finally, a set of elongated holes 152 are provided to secure the platform 35 to the captive pin set 30 (not shown in this FIG.) upon the forward seat arm 80, (not shown in this FIG.) the rear seat arm 100, (not shown in this FIG.) and the intermediate support 130 (not shown in this FIG.) The elongated nature of the elongated holes 152 allows for the varying nature of the captive pin set 30 (not shown in this FIG.) with respect to their spacing.

Figure 5:
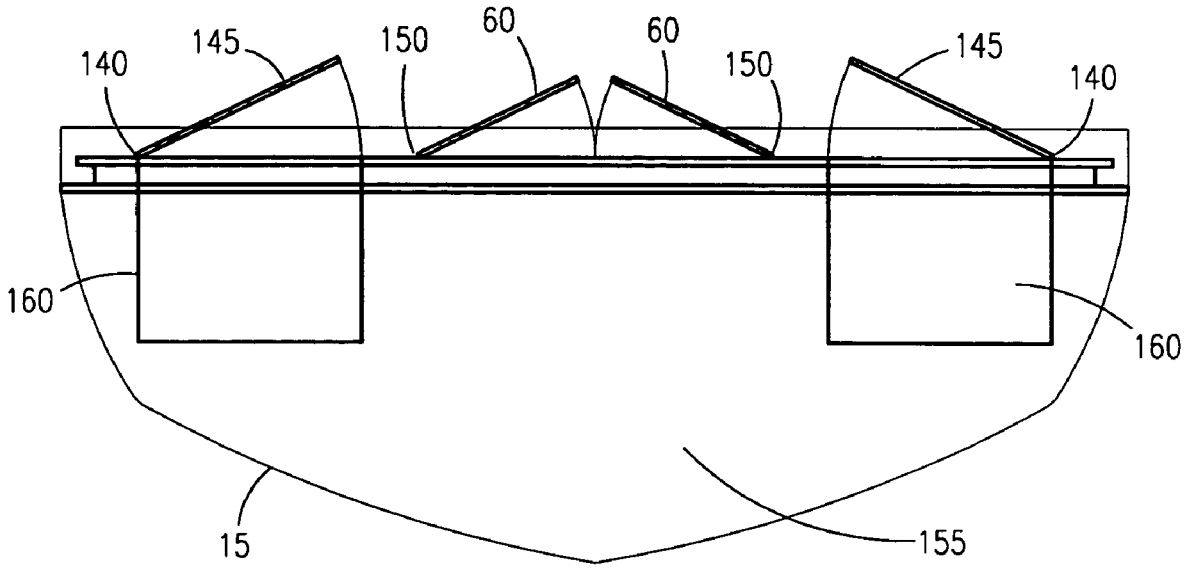

Referring finally to FIG. 5, a sectional view of the adjustable boat platform insert 10 as taken along a line I-I as seen in FIG. 3 is disclosed. This FIG. more clearly shows a below deck storage space 155 as aforementioned described. The forward access hatch 60, as hinged by their hatch hinges 150 are shown in a partially open state. In a likewise manner, the port and starboard storage compartment lid 145 are shown in a partially open state as provided by their compartment hinges 140. The storage compartment lid 145 provide access to a space contained by container walls 160. It is envisioned that the container walls 160 could be thermally insulated in the case of a cooler, or solid in nature, or of a mesh material to allow for drainage.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The preferred embodiment of the present invention can be utilized by the common user in a simple and effortless manner with little or no training. After purchase of the adjustable boat platform insert 10, the typical user would install it upon their conventional V-bottom boat 15. Such installation would consist of adjusting the frame 40 to fit the specific conventional V-bottom boat 15. Such adjustment would be accomplished by inserting or withdrawing the lower first brace 90 into and out of the lower second brace 110 and securing it with a third adjustable pins 120. In a similar manner, the forward brace arms 85 would be adjusted with respect to the lower first brace 90 and secured with the first adjustable pins 95, and the rear brace arms 105 would be adjusted with respect the lower second brace 110 and secured with the second adjustable pins 115. At this point the frame 40 is ready to be secured to the forward seat 20 and aft seat 25 of the conventional V-bottom boat 15. It is also envisioned that adhesive foam should be shock absorbant adhereing to the lower first brace 90 and lower second brace 110 as well as other points of contact to the boat to cushion the platform from the boat. The forward seat arm 80 would connect to the forward seat 20 by the use of adhesive, mechanical fasteners such as screws or bolts, or other well-known fastening techniques. The fourth adjustable pins 136 are used to set the height of the intermediate support to support the center of the platform with respect to the height of the forward seat 20 and the aft seat 25.

The platform 35 can be installed upon the frame 40 at this point in the installation or construction process. The platform 35 is set upon the forward seat arm 80, the rear seat arm 100 and the intermediate support 130 using the elongated holes 152 and the captive pin set 30. The corresponding captive pin set 30 then protrude up through the elongated holes 152 and are thus secured. At this point the seat support mount 134 would be put in place sliding inside the seat support stand 50 and adjusted to desired height with the fifth adjustable pin 138. The centeral seat 45 would then be mounted to the seat support mount 134. At this point the adjustable boat platform insert 10 is ready for use.

During actual use of the conventional V-bottom boat 15 equipped with the adjustable boat platform insert 10, the user can enjoy access to the storage compartments 55 which could be equipped with storage lockers, thermally insulated coolers, live bait containers, fish storage coolers and the like. In a similar manner, the user can access the below deck storage space 155 via the forward access hatch 60 and the rear access hatch 65. Rear access hatch 65 allows normal operation of the boat without having to remove the platform, once removed it has other possible uses.

It is also envisioned that the platform 35 can be removed from the frame 40 to allow use of the conventional V-bottom boat 15 in a conventional manner where the functionality of a V-bottom boat would be needed, as the presence of the frame 40 would not affect functionality.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A universal, adjustable boat platform comprising:

a telescopically adjustable tubular framework coupled between bench seats of a V-hull boat; and a vertically adjustable seat.

2. An adjustable boat platform insert for installation upon a V-bottom boat comprising:

a platform for providing a flat, level, stable and elevated surface from which to perform fishing operations from;

a frame attached to an inside of a V-bottom boat; and a captive pin set for securing said platform to said frame.

3. The adjustable boat platform insert of claim 2, wherein said captive pin set secures said platform to said frame at six locations, two at the forward corners, two at the middle, and two at the aft corners.

4. The adjustable boat platform insert of claim 2, wherein comprising a central seat in a central location affixed to a seat support stand which is mounted to said frame.

5. The adjustable boat platform insert of claim 2, further comprising a plurality of storage compartments around said platform.

6. The adjustable boat platform insert of claim 2, wherein first adjustable pins provides an adjustment point to allow said frame to fit said V-bottom boat of varying sizes.

7. The adjustable boat platform insert of claim 5, wherein said plurality of storage compartments are selected from the group comprising:

a forward access hatch; a rear access hatch; an anchor access hatch; port storage compartment; starboard storage compartment; and thermally insulated cooler.

8. A universal, adjustable platform comprising:

a telescopically adjustable tubular framework;

a vertically adjustable casting seat;

a platform for providing a flat, level, stable and elevated surface from which to perform fishing operations from; and a captive pin set for securing said a platform said a frame.

9. The universal, adjustable platform of claim 8, further comprising:

intermediate support connectable to said tubular framework for respectively connecting two said adjustable platforms side by side.

10. The universal, adjustable platform of claim 8, further comprising intermediate supports comprise a double long footings equipped to mount platforms end to end.

11. The universal, adjustable platform of claim 8, further comprising:

intermediate support connectable to said tubular framework for respectively connecting two said adjustable platforms side by side; and intermediate supports comprise a double long footings equipped to mount platforms end to end.

* * * * *